US009175892B2

(12) United States Patent
Saito et al.

(10) Patent No.: US 9,175,892 B2
(45) Date of Patent: Nov. 3, 2015

(54) ICE MAKING DEVICE

(75) Inventors: Shunji Saito, Nagano (JP); Haruhiko Wada, Nagano (JP)

(73) Assignee: NIDEC SANKYO CORPORATION (JP)

( * ) Notice: Subject to any disclaimer, the term of this patent is extended or adjusted under 35 U.S.C. 154(b) by 861 days.

(21) Appl. No.: 13/498,018

(22) PCT Filed: Aug. 2, 2010

(86) PCT No.: PCT/JP2010/004857

§ 371 (c)(1),
(2), (4) Date: Jun. 1, 2012

(87) PCT Pub. No.: WO2011/036842

PCT Pub. Date: Mar. 31, 2011

(65) Prior Publication Data

US 2012/0240613 A1 Sep. 27, 2012

(30) Foreign Application Priority Data

Sep. 24, 2009 (JP) ..... 2009-218905
May 17, 2010 (JP) ..... 2010-113208

(51) Int. Cl.
*F25C 5/18* (2006.01)
*F25D 3/02* (2006.01)
*F25C 1/24* (2006.01)

(52) U.S. Cl.
CPC . *F25C 1/24* (2013.01); *F25C 5/187* (2013.01); *F25C 2305/022* (2013.01)

(58) Field of Classification Search
CPC .... F25C 5/002; F25C 5/007; F25C 2305/022; F25C 2400/06; F25D 23/06; F25D 11/02
USPC ..... 62/344
See application file for complete search history.

(56) References Cited

U.S. PATENT DOCUMENTS 7,204,092 B2 * 4/2007 Azcarate Castrellon et al. . 62/72
7,934,389 B2 * 5/2011 Yoon et al. ..... 62/344
2007/0012061 A1 * 1/2007 Ribeiro et al. ..... 62/344

(Continued)

FOREIGN PATENT DOCUMENTS

JP 63-196064 U 12/1988
JP 4-15466 A 1/1992
JP 6-317370 A 11/1994
JP 2001-165538 A 6/2001

(Continued)

OTHER PUBLICATIONS

International Search Report for International Application No. PCT/JP2010/004857, mailed Aug. 31, 2010.

*Primary Examiner* — Allen Flanigan
*Assistant Examiner* — Filip Zec
(74) *Attorney, Agent, or Firm* — Cantor Colburn LLP

(57) ABSTRACT

An ice making device may include an ice tray; a drive part which is provided with an output shaft to which the ice tray is attached and in which the ice tray is turned by turning of the output shaft; and a frame body to which the drive part is attached. A twisting operation is applied to the ice tray during a turning operation for separating ice pieces from the ice tray. The drive part may include a drive side attaching part. The frame body may include a frame body side attaching part. The frame body side attaching part and the drive side attaching part are fitted to each other along a direction that is perpendicular to the output shaft, thereby attaching the drive part to the frame body.

6 Claims, 8 Drawing Sheets

(56) References Cited

U.S. PATENT DOCUMENTS

2010/0163707 A1* 7/2010 Kim ..... 249/120
2010/0257888 A1* 10/2010 Kang et al. ..... 62/340

FOREIGN PATENT DOCUMENTS

JP 2004-332981 A 11/2004
JP 2006-266538 A 10/2006

* cited by examiner

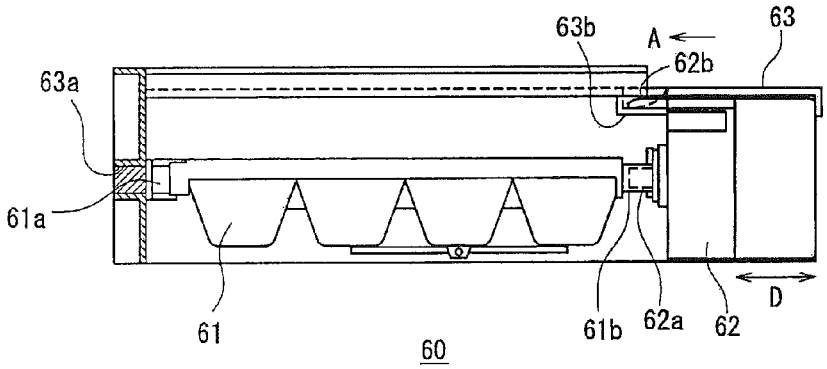
Fig. 8(a) - Prior Art
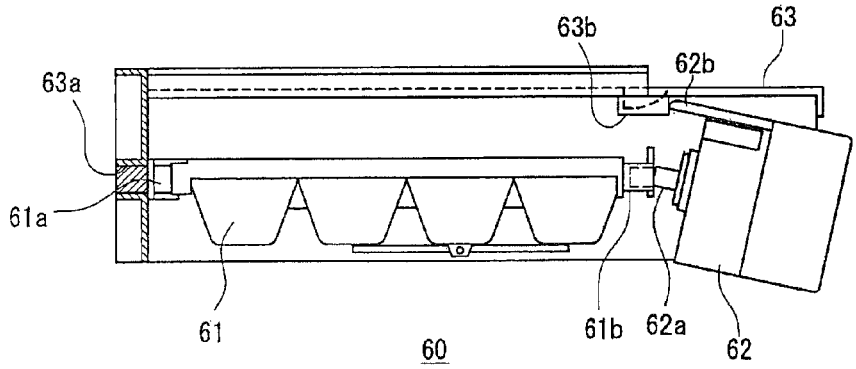
Fig. 8(b) – Prior Art

ICE MAKING DEVICE

CROSS REFERENCE TO RELATED APPLICATIONS

This is a U.S. national stage of application No. PCT/JP2010/004857, filed on Aug. 2, 2010. Priority under 35 U.S.C. §119(a) and 35 U.S.C. §365(b) is claimed from Japanese Application No. 2009-218905, filed Sep. 24, 2009; and Japanese Patent Application No. 2010-113208, filed May 17, 2010, the disclosures of which are also incorporated herein by reference.

TECHNICAL FIELD

The present invention relates to an ice making device. More specifically, the present invention relates to an ice making device which is installed in a refrigerator to manufacture ice pieces in the refrigerator and to supply manufactured ice pieces to an ice storage container in the refrigerator.

BACKGROUND

Conventionally, a refrigerator such as a household refrigerator has been known which is provided with an ice making function in which ice pieces are manufactured and manufactured ice pieces are supplied to an ice storage container for storing ice pieces that is arranged within the refrigerator.

As this type of an ice making device, for example, the ice making device described in Patent Literature 1 and the like has been known. Specifically, as shown in FIG. 8(*a*), an ice making device 60 is disclosed which is provided with an ice tray 61 for manufacturing ice pieces, a turning drive part 62 which turns the ice tray 61 to make manufactured ice pieces drop from the ice tray 61, and a frame body 63 to which the ice tray 61 and the turning drive part 62 are attached.

[PTL 1] Japanese Patent Laid-Open No. 2001-165538

In the ice making device 60 shown in FIG. 8(*a*), in order to attach the ice tray 61 and the turning drive part 62 to the frame body 63, the following method is conceivable. In other words, as shown in FIG. 8(*b*), one end 61*a* of a turning shaft of the ice tray 61 is inserted into a through hole 63*a* of the frame body 63 and the one end 61*a* of the turning shaft is supported by the frame body 63. After that, while the other end 61*b* of the turning shaft of the ice tray 61 is fitted to an output shaft 62*a* of the turning drive part 62, a fixing pawl piece 62*b* of the turning drive part 62 is inserted into a pawl piece fixing part 63*b* of the frame body 63. In this case, the fixing pawl piece 62*b* is deformed to be inserted into the pawl piece fixing part 63*b*. However, it is difficult for the fixing pawl piece 62*b* and the pawl piece fixing part 63*b* to secure a sufficient strength which is capable of enduring the deformation.

On the other hand, for example, a method may be conceivable in which the output shaft 62*a* of the turning drive part 62 is fitted to the other end 61*b* of the turning shaft of the ice tray 61 while the turning drive part 62 is slid in a direction of the arrow "A" in FIG. 8(*a*) (direction of the output shaft 62*a* of the turning drive part 62). However, in this case, for example, the following design change is required. In other words, a wall part located on an outer side in the direction of the output shaft 62*a* of the turning drive part 62 is removed, or the frame body 63 is extended to the outer side to secure a space so that the turning drive part 62 is capable of sliding. When the wall part located on the outer side in the direction of the output shaft 62*a* of the turning drive part 62 is removed, the strength of the frame body 63 is decreased and thus this design change is difficult. Alternatively, when a space where the turning drive part 62 is capable of sliding is provided, after the output shaft 62*a* has been fitted to the other end 61*b*, a dead space is formed on the outer side of the turning drive part 62 in the direction of the arrow "D" and thus the size of the ice making device 60 is unnecessarily made larger in the direction of the output shaft 62*a* of the turning drive part 62.

SUMMARY

An objective of the present invention is to provide an ice making device whose assembling property is improved by restraining an unnecessary space which occurs when assembling is performed.

In this type of an ice making device, an ice detecting member is used for detecting insufficiency of ice pieces stored within an ice storage container in which manufactured ice pieces are stored and thus, the present inventors had considered that an unnecessary space which is used when assembling is performed is utilized as an attaching space of the ice detecting member and, as a result, the present invention has been completed.

In other words, an ice making device in accordance with the present invention includes an ice tray, a drive part which is provided with an output shaft to which the ice tray is attached and in which the ice tray is turned by turning of the output shaft, and a frame body to which the drive part is attached. In the ice making device, a twisting operation is applied to the ice tray during the turning operation of the ice tray to separate ice pieces from the ice tray. The drive part is provided with a drive side attaching part which is capable of fitting to a frame body side attaching part for attaching the drive part to the frame body within the frame body, and the drive part is attached to the frame body by means of that the frame body side attaching part and the drive side attaching part are fitted to each other along a direction that is perpendicular to the output shaft.

In this case, it is preferable that, when the drive part is to be attached to the frame body, the drive part is moved along the direction that is perpendicular to the output shaft, a space is formed between the drive part and the frame body on a rear side in a moving direction of the drive part when the drive part has been moved along the direction, and a rear side in the moving direction of the drive part which faces the space is attached with an ice detecting member for detecting an amount of ice pieces within an ice storage container which is disposed on an under side of the ice tray.

Further, it is desirable that the ice detecting member is fitted to an ice detecting shaft for turning the ice detecting member, which is disposed on a rear side in the moving direction of the drive part, along the direction that is perpendicular to the output shaft, and a distance of the ice detecting member which is moved when the ice detecting member is fitted to the ice detecting shaft is shorter than a distance of the drive part which is moved when the drive part is attached to the frame body.

Further, it is desirable that one end of a turning shaft of the ice tray is supported by the frame body, the other end of the turning shaft is fitted to the output shaft of the drive part so that turning drive of the drive part is capable of being transmitted, the ice tray is twisted by means of that a protruded part for twisting provided on one end side of the ice tray is abutted with an abutting part provided on the frame body, which causes to disturb turning of the ice tray, and a moving direction of the drive part when the drive part is attached to the frame body is the same direction as a direction of force transmitted to the drive side attaching part through the output shaft of the drive part from the ice tray against twisting applied to the ice tray.

In addition, it is desirable that the drive side attaching part is structured of a pawl piece which is protruded from the drive part, the frame body side attaching part is structured of a pawl insertion part into which the pawl piece is inserted, and an area of a first abutting face of the pawl insertion part which is abutted with the pawl piece and which is received with a force in a vertical direction transmitted to the pawl piece through the output shaft of the drive part from the ice tray against twisting applied to the ice tray is larger than an area of a second abutting face of the pawl insertion part which is abutted with the pawl piece and which is disposed at a position sandwiching the pawl piece with the first abutting face.

Further, it is desirable that a reinforcing rib which reinforces the pawl insertion part is provided on the first abutting face side of the pawl insertion part.

Further, it is desirable that the first abutting face and the second abutting face are not overlapped with each other in the direction perpendicular to the output shaft and in the direction perpendicular to an attaching direction of the drive part.

According to the ice making device in accordance with the present invention, the drive part is attached to the frame body by means of that the frame body side attaching part of the frame body and the drive side attaching part of the drive part are fitted to each other along the direction perpendicular to the output shaft of the drive part and thus a dead space is not formed in the direction of the output shaft of the drive part. Therefore, occurrence of an unnecessary space at the time of assembling is restrained and thus assembling property is improved.

In this case, a space is provided due to attaching of the drive part in the direction perpendicular to the output shaft of the drive part. However, the space is utilized as the attaching space of the ice detecting member. Therefore, occurrence of an unnecessary space at the time of assembling is restrained and thus assembling property is improved.

In this case, the ice detecting member is fitted and attached on the rear side in the moving direction of the drive part along the direction that is perpendicular to the output shaft and, when the moving distance of the ice detecting member at the time of fitting is set to be shorter than the moving distance of the drive part when the drive part is fitted and attached to the frame body, the space in the (horizontal) direction perpendicular to the output shaft which is used for attaching the drive part can be utilized as a moving space for attaching the ice detecting member. Therefore, occurrence of an unnecessary space at the time of assembling is restrained and thus assembling property is improved.

Further, in a case that the moving direction of the drive part when the drive part is attached to the frame body is set to be the same direction as the direction of the force which is transmitted to the drive side attaching part through the output shaft of the drive part from the ice tray against the twisting applied to the ice tray, disengagement of the drive part from the frame body is prevented by the force acted on the drive part due to the twisting operation of the ice tray. Therefore, even when the ice tray is twisted, the drive part is fixed surely.

In addition, in a case that the drive side attaching part is structured of a pawl piece and the frame body side attaching part is structured of a pawl insertion part into which the pawl piece is inserted, when an area of a first abutting face of the pawl insertion part which is abutted with the pawl piece and which is received with a force in a vertical direction transmitted to the pawl piece through the output shaft of the drive part from the ice tray against the twisting applied to the ice tray is larger than an area of a second abutting face of the pawl insertion part which is abutted with the pawl piece and which is disposed at a position sandwiching the pawl piece with the first abutting face, a face where the force is applied is set to be larger and thus a holding force for the drive part is enhanced.

Further, in this case, when a reinforcing rib which reinforces the pawl insertion part is provided on the first abutting face side, the strength of the face where the force is applied is improved and thus the holding force for the drive part is further enhanced.

Further, when the first abutting face and the second abutting face are not overlapped with each other in the direction perpendicular to the output shaft and in the direction perpendicular to the attaching direction of the drive part, the pawl insertion part is structured without using a slide core as a die for resin molding.

BRIEF DESCRIPTION OF DRAWINGS

Embodiments will now be described, by way of example only, with reference to the accompanying drawings which are meant to be exemplary, not limiting, and wherein like elements are numbered alike in several Figures, in which:

FIG. 8(*a*) is a side view showing a conventional ice making device and FIG. 8(*b*) is a schematic view showing an example of an attaching method of the ice making device.

DESCRIPTION OF EMBODIMENTS

Figure 1:
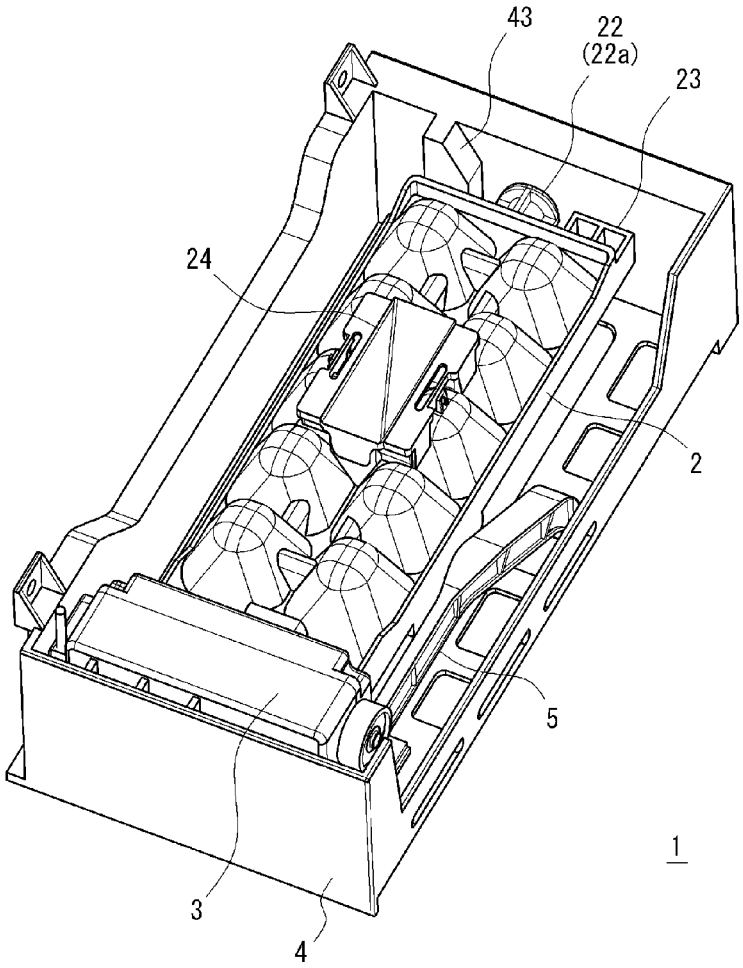
FIG. 1 is a perspective view showing an ice making device in accordance with an embodiment of the present invention.

Next, an embodiment of the present invention will be described in detail below. As shown in FIG. 1, an ice making device 1 in accordance with an embodiment of the present invention is provided with an ice tray 2, a drive part 3 to which the ice tray 2 is attached and by which the ice tray 2 is turned, a frame body 4 to which the drive part 3 is attached, and an ice detecting member 5 which is attached to the drive part 3 for detecting an amount of ice pieces stored in an ice storage container not shown where manufactured ice pieces are stored. The ice making device 1 shown in FIG. 1 is viewed from a lower side.

The ice tray 2 is structured in a rectangular shape and is provided with a plurality of recessed parts to which water is supplied from a water-supply part not shown for storing water for making ice pieces. The ice tray 2 includes a turning shaft 22 along a longitudinal direction and is turnable with the turning shaft 22 as a turning center. A protruded part 23 for twisting which is used for twisting the ice tray 2 is formed on one end side in the longitudinal direction of the ice tray 2 so as to protrude toward an outer side in the longitudinal direction from the one end. The protruded part 23 for twisting is turned around the turning shaft 22 with turning of the ice tray 2 around the turning shaft 22.

The ice tray 2 is formed of resin material or the like which is elastically deformable and, when a twisting force is applied around the turning shaft 22, the ice tray 2 is capable of being deformed. The other end of the turning shaft 22 of the ice tray 2 is formed with a fitting groove not shown which is capable of fitting to the output shaft 32 of the drive part 3. In this embodiment, a thermistor 24 for detecting temperature of the ice tray 2 is attached at a lower part of the ice tray 2.

Figure 2:
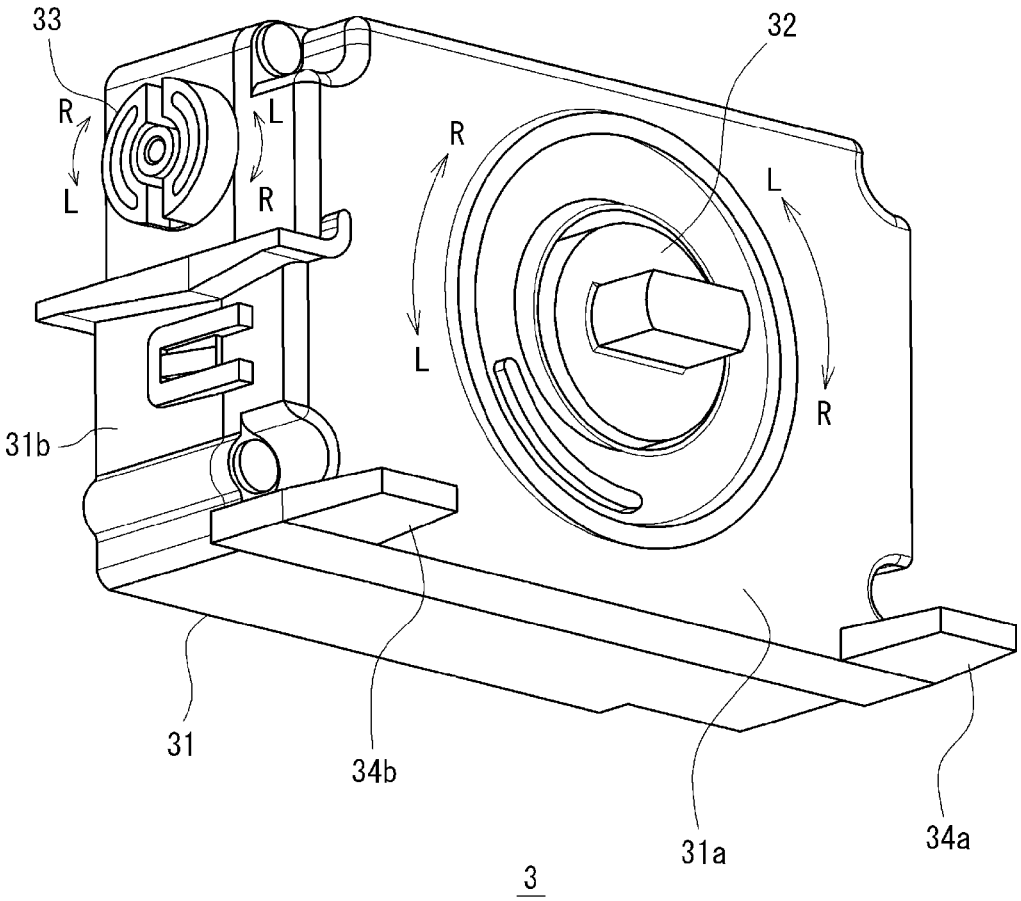
FIG. 2 is a schematic view showing an example of a drive part in an ice making device.

The drive part 3 to which the ice tray 2 is attached includes, as shown in FIG. 2, a motor not shown which is a drive source, a rotation transmission mechanism not shown for transmitting a rotational force of the motor, and a cam gear not shown to which the rotational force of the motor is transmitted through the rotation transmission mechanism in a rectangular case 31 which is formed in a parallelepiped shape. The rotation transmission mechanism is structured of a worm gear and a gear train not shown and the rotational force of the motor is transmitted to the gear train through the worm gear which is connected with the motor.

The cam gear within the drive part 3 is integrally formed with an output shaft 32 with which the other end of the turning shaft 22 of the ice tray 2 is connected for transmitting the rotational force of the motor to the ice tray 2. The output shaft 32 is protruded to an outer side of the case 31 from a hole provided in a wide opening face 31*a* on one side of the case 31. The output shaft 32 is turnable by the rotational force of the motor which is transmitted to the cam gear through the rotation transmission mechanism. The output shaft 32 is turned in a clockwise direction (right side turning, the arrow "R" direction) when ice pieces are to be separated from the ice tray 2 and, when the ice tray 2 having been turned for ice separating operation is to be turned to the original position, the output shaft 32 is turned in a counterclockwise direction (left side turning, the arrow "L" direction).

Further, an ice detecting mechanism which is operated by the cam gear is provided within the case 31 of the drive part 3. The ice detecting mechanism includes an ice detecting shaft lever not shown, which is operated by a cam face on a turning center side of a ring-shaped recessed part not shown that is formed on a face of the cam gear, an ice detecting shaft 33 which transmits movement of the ice detecting shaft lever to an ice detecting member 5, and a coiled spring not shown which applies a force for swinging the ice detecting shaft 33. The ice detecting shaft 33 is protruded toward an outer side of the case 31 from an aperture provided in a side face 31*b* on one side of the case 31. The ice detecting shaft 33 is turned with turning of the cam gear. The ice detecting shaft 33 is turned in a counterclockwise direction (left side turning, the arrow "L" direction) when an ice detecting operation is performed and, when returned to the original position, the ice detecting shaft 33 is turned in a clockwise direction (right side turning, the arrow "R" direction).

Two pawl pieces 34*a* and 34*b* which are drive side attaching parts for attaching the drive part 3 to the frame body 4 are formed so as to protrude toward a projecting direction of the output shaft 32 from the wide opening face 31*a* of the case 31 from which the output shaft 32 is projected. The pawl pieces 34*a* and 34*b* are formed on an upper side of the drive part 3 which is attached to the frame body 4.

Figure 3:
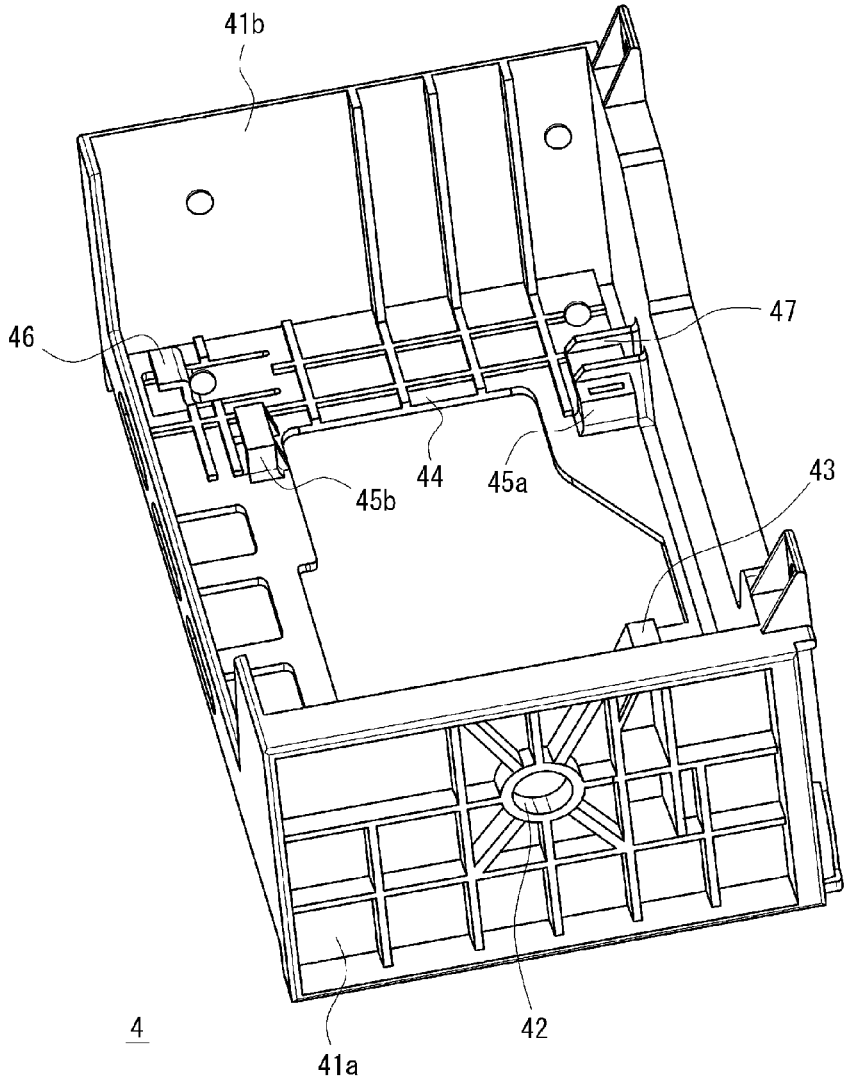
FIG. 3 is a schematic view showing an example of a frame body in an ice making device.

As shown in FIG. 3, the frame body 4 to which the drive part 3 is attached is structured in a rectangular shape so as to surround in all directions with side walls and so that its upper face and under face are opened. A side wall 41*a* on one end side in a longitudinal direction is formed with an insertion hole 42 into which one end 22*a* of the turning shaft 22 of the ice tray 2 is inserted for turnably supporting the ice tray 2. The insertion hole 42 is provided with an inner diameter a little larger than an outer diameter of the one end 22*a* of the turning shaft 22 of the ice tray 2, and the one end 22*a* of the turning shaft 22 of the ice tray 2 is loosely fitted to the insertion hole 42. Further, the side wall 41*a* is provided with an abutting part 43, with which the protruded part 23 for twisting provided on one end side in the longitudinal direction of the ice tray 2 is abutted when the ice tray 2 is turned, so as to protrude from the side wall 41*a* toward an inner side direction of the frame body 4.

On a side wall 41*b* on the other end side in the longitudinal direction of the frame body 4, a part of an upper face is closed with a top plate 44, and the drive part 3 is attached to the top plate 44. The top plate 44 is formed so as to match the size of the drive part 3 with pawl insertion parts 45*a* and 45*b*, which are frame body side attaching parts for attaching the drive part 3 and into which the pawl pieces 34*a* and 34*b* of the drive part 3 are capable of inserting, and a pressing part 46 for pressing the drive part 3 so that the drive part 3 attached to the frame body 4 does not move.

Figure 4:
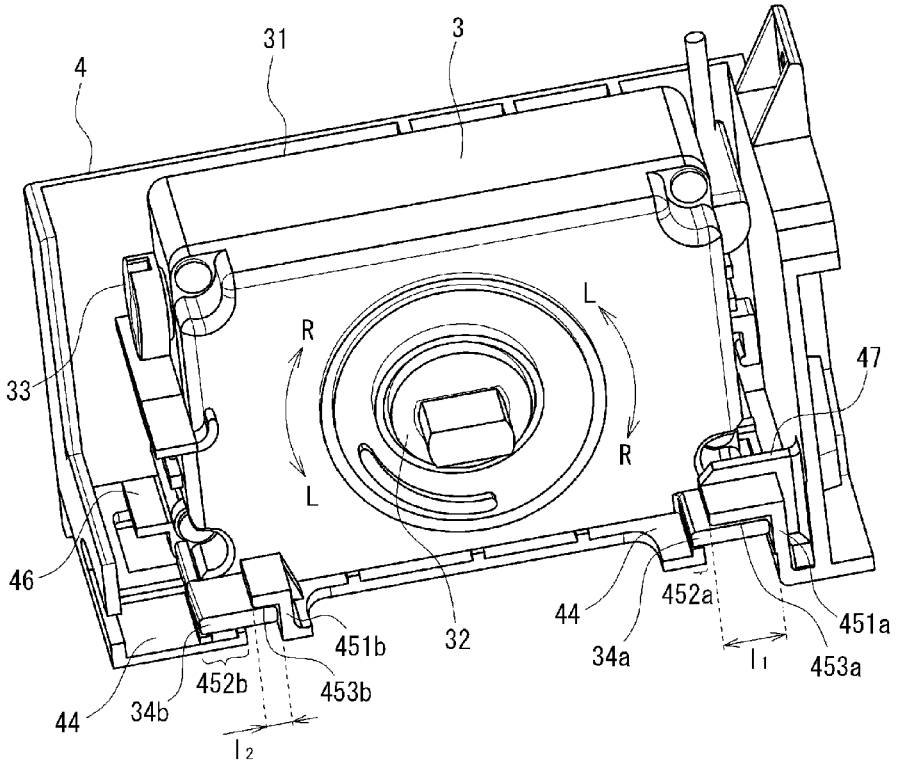
FIG. 4 is an explanatory cross-sectional view showing a state where pawl pieces of the drive part are inserted into pawl insertion parts of the frame body.

FIG. 4 is a cross sectional perspective view showing a state where the drive part 3 has been attached to the frame body 4 and which is cut in a vertical direction along a face including the pawl insertion parts 45*a* and 45*b* in order to explain a state where the pawl pieces 34*a* and 34*b* of the drive part 3 are inserted into the pawl insertion parts 45*a* and 45*b* of the frame body 4. As shown in FIG. 4, the pawl insertion parts 45*a* and 45*b* are structured of pawl insertion pieces 451*a* and 451*b*, which are stood in a hooked shape from the top plate 44 to an inner side in a vertical direction of the frame body 4, and top plate side abutting faces 452*a* and 452*b* which are to be abutted with the pawl pieces 34*a* and 34*b* of the drive part 3. The pawl insertion pieces 451*a* and 451*b* are provided with insertion piece side abutting faces 453*a* and 453*b* which are abutted with the pawl pieces 34*a* and 34*b* of the drive part 3 and the pawl pieces 34*a* and 34*b* of the drive part 3 are inserted between the insertion piece side abutting faces 453*a* and 453*b* and the top plate side abutting faces 452*a* and 452*b*.

Two pawl insertion parts 45*a* and 45*b* are provided in accordance with the number of the pawl pieces 34*a* and 34*b* of the drive part 3. Each of the pawl insertion parts 45*a* and 45*b* is integrally molded on the top plate 44 by using dies structured to be separated from each other in an upper direction and a lower direction without using a slide core. The pawl insertion pieces 451*a* and 451*b* and the top plate 44 are structured so as not to overlap with each other in the upper and lower direction. Each of the pawl insertion parts 45*a* and 45*b* is opened in the same direction along a horizontal direction which is perpendicular to the output shaft 32 of the drive part 3 that is attached to the frame body 4 (in FIG. 4, the pawl insertion parts 45*a* and 45*b* are opened to the left side in the horizontal direction).

In each of the pawl insertion parts 45*a* and 45*b*, its opening direction is associated with the turning direction of the output shaft 32 of the drive part 3 which is attached to the frame body 4. In other words, when a face from which the output shaft 32 is protruded is viewed as a front face, each of the pawl insertion parts 45*a* and 45*b* is opened so that the drive part 3 is moved (slid) in a direction opposite to the turning direction of the output shaft 32 for turning the ice tray 2 when an ice separating operation of manufactured ice pieces is to be performed. Specifically, as shown in FIG. 4, the turning direction of the output shaft 32 is a clockwise direction (right side turning, direction of the arrow "R") and, on an upper side of the drive part 3 where the pawl pieces 34*a* and 34*b* are provided, the output shaft 32 is turned from the right side to the left side. Since the left sides of the pawl insertion parts 45*a* and 45*b* of the frame body 4 are opened and, when the pawl pieces 34*a* and 34*b* are to be inserted into the pawl insertion parts 45*a* and 45*b*, the drive part 3 is moved from the left side to the right side in the horizontal direction perpendicular to the output shaft 32 of the drive part 3. Positions in the horizontal direction of the inserted pawl pieces 34*a* and 34*b* are determined by the pawl insertion pieces 451*a* and 451*b*.

One of the two pawl insertion parts 45*a* and 45*b* (first pawl insertion part 45*a*) is provided on a front side in the moving direction of the drive part 3 (right side in FIG. 4) at a position in the vicinity of a side wall of the frame body 4. On the other hand, the other pawl insertion part (second pawl insertion part 45*b*) is provided on a rear side in the moving direction of the drive part 3 (left side in FIG. 4) and on an inner side in the horizontal direction of the frame body 4 by a moving length of the drive part 3 with respect to a side wall of the frame body 4.

In the first pawl insertion part 45*a* which is disposed on the front side in the moving direction of the drive part 3, an area of the insertion piece side abutting face 453*a* (a first abutting face) is structured to be larger than an area of the top plate side abutting face 452*a* (a second abutting face). In the second pawl insertion part 45*b* which is disposed on the rear side in the moving direction of the drive part 3, an area of the top plate side abutting face 452*b* (a first abutting face) is structured to be larger than an area of the insertion piece side abutting face 453*b* (a second abutting face). Further, the pawl insertion piece 451*a* of the first pawl insertion part 45*a* is formed with a reinforcing rib 47 on a face opposite to the insertion piece side abutting face 453*a* and the pawl insertion piece 451*a* of the first pawl insertion part 45*a* is reinforced by the reinforcing rib 47.

The lengths "l1" and "l2" of the insertion piece side abutting faces 453*a* and 453*b* in the pawl insertion parts 45*a* and 45*b* in the moving direction of the drive part 3 are insertion lengths of the pawl pieces 34*a* and 34*b* which are inserted into the pawl insertion parts 45*a* and 45*b*. The insertion length "l2" in the second pawl insertion part 45*b* is set to be a shorter length so that the pawl piece 34*b* of the drive part 3 is engaged with the pawl insertion piece 451*b* of the second pawl insertion part 45*b* for only preventing coming-off of the pawl piece 34*b*. On the other hand, the insertion length "l1" in the first pawl insertion part 45*a* (length "l1" of the insertion piece side abutting face 453*a* of the first pawl insertion part 45*a* in the moving direction of the drive part 3) is structured to be longer than the length "l2" of the insertion piece side abutting face 453*b* of the second pawl insertion part 45*b* in the moving direction of the drive part 3 in order to provide a larger holding force than the force preventing the coming-off of the pawl piece 34*a*.

The pressing part 46 of the frame body 4 is, as shown in FIG. 3, structured of a cut piece which is formed by means of that a part of the top plate 44 is cut along the moving direction of the drive part 3 that is attached to the frame body 4. The pressing part 46 is elastically deformable (deflectable and deformable) in a direction perpendicular to the face of the top plate 44. A tip end side of the cut piece is formed in a bent piece which is bent in an inner side direction of the frame body 4 that is perpendicular to the top plate 44 and a tip end of the bent piece is bent to the rear side in the moving direction of the drive part 3 which is attached to the frame body 4. The pressing part 46 is disposed on the rear side in the moving direction of the drive part 3 attached to the frame body 4 and the side face 31*b* on the rear side in the moving direction of the drive part 3 can be held by the bent piece.

Figure 5:
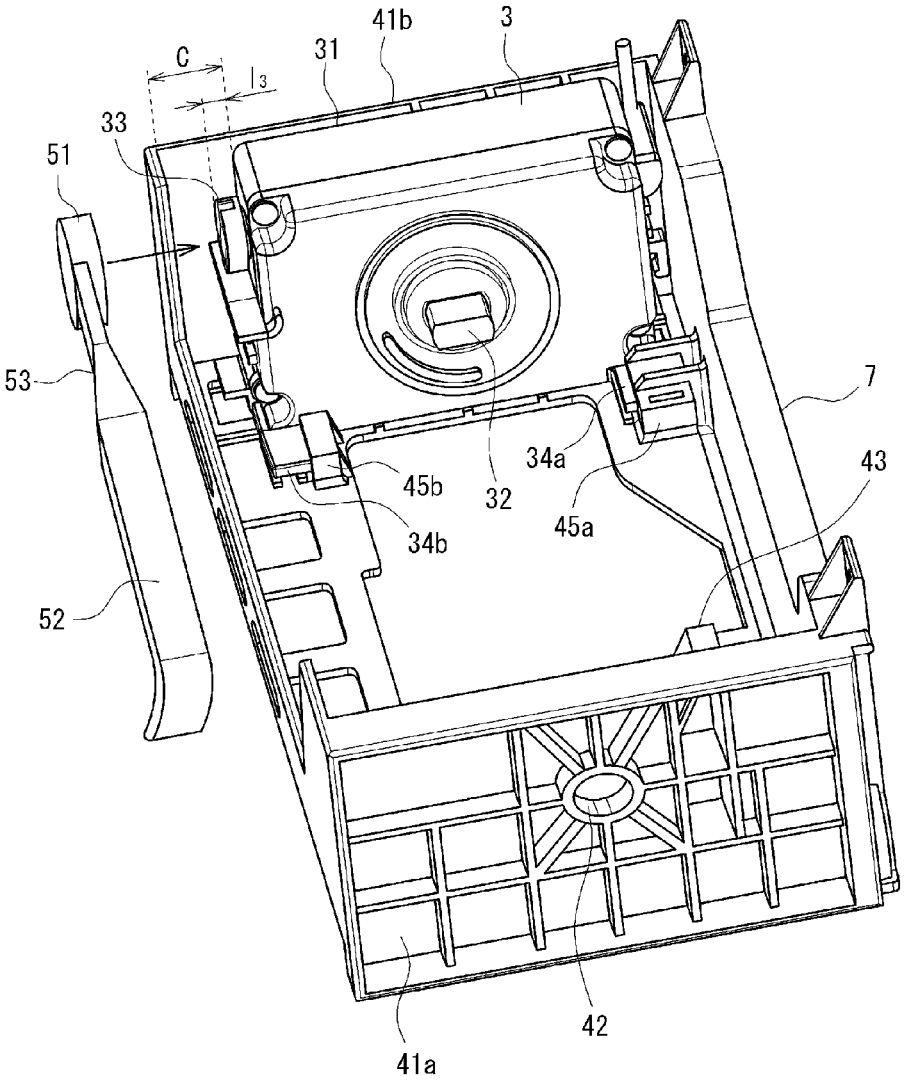
FIG. 5 is a schematic view showing a state where an ice detecting member is to be attached to the drive part which has been attached to the frame body.

As shown in FIG. 5, the ice detecting member 5 attached to the drive part 3 is structured of an ice detecting shaft fixing part 51, which is fixed to the ice detecting shaft 33 that is formed so as to protrude in the horizontal direction from the case side face 31*b* on the rear side in the moving direction of the drive part 3, an ice detecting part 52 which is arranged on an under side of the ice tray 2 for performing an ice detecting operation in which the ice detecting part 52 is abutted with ice pieces within the ice storage container not shown where manufactured ice pieces are stored, and a connecting part 53 which connects the ice detecting shaft fixing part 51 with the ice detecting part 52. The ice detecting member 5 is formed in an arm shape. Turning of the ice detecting shaft 33 is transmitted to the ice detecting member 5 through the ice detecting shaft fixing part 51. Therefore, when an ice detecting operation is performed, the ice detecting part 52 is turned in a counterclockwise direction (left side turning) around the ice detecting shaft fixing part 51 and moved down. Further, when the ice detecting part 52 is returned to the original position, the ice detecting part 52 is moved upward by means of that the ice detecting part 52 is turned in the clockwise direction (right side turning) around the ice detecting shaft fixing part 51.

Next, an assembling method for the ice making device 1 will be described below.

First, one end 22*a* of the turning shaft 22 of the ice tray 2 is inserted into the insertion hole 42 provided in the side wall 41*a* on one end side in the longitudinal direction of the frame body 4. Next, the drive part 3 is attached to the frame body 4 while the output shaft 32 of the drive part 3 is fitted into the fitting groove not shown which is formed at the other end of the turning shaft 22 of the ice tray 2. In this manner, the one end 22*a* of the turning shaft 22 of the ice tray 2 is turnably supported by the frame body 4 and the other end 22*b* is fitted to the output shaft 32 of the drive part 3 so that turning driving can be transmitted.

In this case, the one end 22*a* of the turning shaft 22 of the ice tray 2 is loosely fitted to the insertion hole 42 of the side wall 41*a* of the frame body 4. Therefore, the other end of the turning shaft 22 of the ice tray 2 is disposed on the rear side in the moving direction of the drive part 3 with respect to the one end 22*a* of the turning shaft 22 and, in a state where the ice tray 2 is disposed such that the turning shaft 22 of the ice tray 2 is slightly inclined with respect to a direction along the longitudinal direction of the frame body 4, while the other end of the turning shaft 22 of the ice tray 2 is fitted to the output shaft 32 of the drive part 3, as shown in FIG. 6(*a*), the pawl pieces 34*a* and 34*b* of the drive part 3 are positioned at the opening ends of the pawl insertion parts 45*a* and 45*b* of the frame body 4.

Figure 6A:
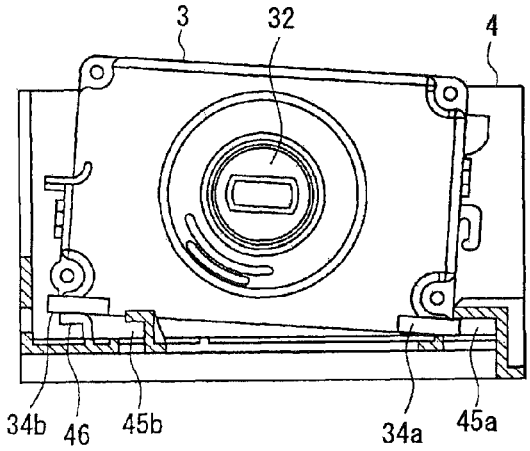
FIGS. 6(*a*), 6(*b*) and 6(*c*) are explanatory schematic views showing steps in which the drive part is attached to the frame body.
Figure 6B:
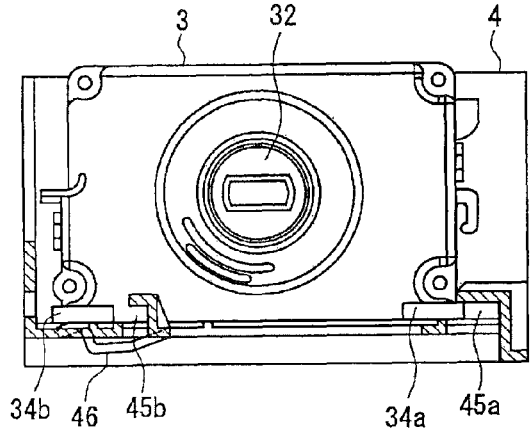
Figure 6C:
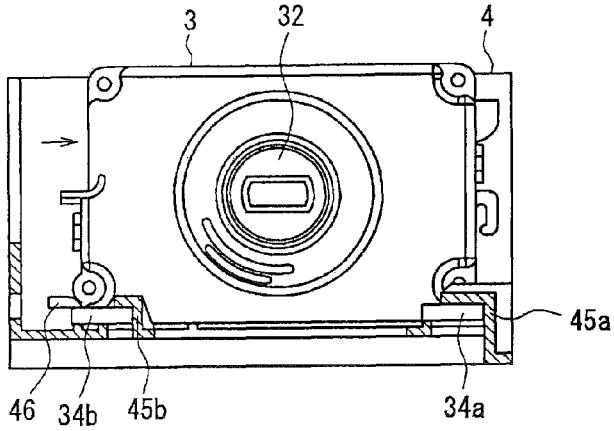

Next, as shown in FIG. 6(*b*), the pressing part 46 of the frame body 4 is pressed down by the main body of the drive part 3 so that the pressing part 46 is resiliently bent. In this state, as shown in FIG. 6(*c*), the drive part 3 is moved (slid) from the left side to the right side in the horizontal direction perpendicular to the output shaft 32 of the drive part 3 and the pawl pieces 34*a* and 34*b* of the drive part 3 are inserted into the pawl insertion parts 45*a* and 45*b* of the frame body 4.

At the same time when the pawl pieces 34*a* and 34*b* of the drive part 3 are inserted, the other end of the turning shaft 22 of the ice tray 2 is also moved from the left to the right in the horizontal direction perpendicular to the output shaft 32 of the drive part 3 and thus the ice tray 2 is disposed in a direction parallel to the longitudinal direction of the frame body 4. When the pawl pieces 34*a* and 34*b* of the drive part 3 are inserted into inner portions of the pawl insertion parts 45*a* and 45*b* of the frame body 4, the drive part 3 is passed through the bent piece of the pressing part 46 and thus the pressing part 46 which has been resiliently bent is returned to its original position. In this manner, the side face 31*b* on the rear side in the moving direction of the drive part 3 is supported by the bent piece of the pressing part 46.

Next, the ice detecting member 5 is attached to the ice detecting shaft 33 of the drive part 3. When the drive part 3 is attached to the frame body 4, as shown in FIG. 5, a space "C" is provided between the side face 31*b* on the rear side in the moving direction of the drive part 3 and the side wall portion of the frame body 4. The ice detecting shaft 33 is protruded from the case side face 31*b* facing the space "C" on the rear side in the moving direction of the drive part 3. The ice detecting member 5 is attached in the space "C" by utilizing the space "C". Specifically, the ice detecting shaft fixing part 51 of the ice detecting member 5 and the ice detecting shaft 33 of the drive part 3 are fitted to each other along the horizontal direction perpendicular to the output shaft 32 of the drive part 3. In this case, since the ice detecting member 5 is moved to the right direction, the fitting direction is coincided with the direction in which the pawl pieces 34*a* and 34*b* of the drive part 3 are inserted into the pawl insertion parts 45*a* and 45*b* of the frame body 4. A moving distance "l3" of the ice detecting member 5 at the time of fitting is shorter than the moving distance "l1" of the drive part 3 when the drive part 3 is attached.

Next, an operation of the ice making device 1 will be described below.

First, ice pieces are manufactured on the ice tray 2. Specifically, water is supplied from a water-supply part not shown to the ice tray 2 which is disposed horizontally and the water supplied to the ice tray 2 is frozen by a cooling part not shown which is disposed on an upper side of the ice tray 2. Whether ice pieces have been manufactured or not is judged whether or not the thermistor 24 attached on the lower part of the ice tray 2 detects a predetermined temperature or below the temperature.

When the ice making operation has been completed, an amount of ice pieces within the ice storage container not shown which is disposed on an under side of the ice tray 2 is detected by the ice detecting member 5. Specifically, the ice detecting member 5 is turned around the ice detecting shaft fixing part 51 by turning of the ice detecting shaft 33 of the drive part 3 and the ice detecting part 52 of the ice detecting member 5 is moved down. When the ice detecting part 52 is moved down to a predetermined position, it is judged that ice pieces within the ice storage container are not sufficient. On the other hand, when the ice detecting part 52 is abutted with ice pieces within the ice storage container before moving down to the predetermined position, it is judged that ice pieces within the ice storage container are sufficient.

When ice pieces within the ice storage container are sufficient, after having waited for a predetermined time period, an amount of ice pieces within the ice storage container is detected again by the ice detecting member 5. Detecting operation for an amount of ice pieces by the ice detecting member 5 is repeatedly performed through a predetermined waiting time period until it is judged that ice pieces within the ice storage container are not sufficient.

When ice pieces within the ice storage container are not sufficient (ice pieces within the ice storage container is insufficient), an ice separating operation of ice pieces manufactured on the ice tray 2 is performed. Specifically, the ice tray 2 connected with the output shaft 32 is turned by turning of the output shaft 32 of the drive part 3. When the ice tray 2 is turned by a predetermined turning angle of 90 degrees or more (for example, 120 degrees) from the first position where the ice tray 2 is disposed horizontally, the protruded part 23 for twisting of the ice tray 2 is abutted with the abutting part 43 of the frame body 4. In this state, a further turning of the ice tray 2 is obstructed and the ice tray 2 is twisted with the turning shaft 22 of the ice tray 2 as its twisting center. Therefore, the ice tray 2 is torsionally deformed. In this manner, ice pieces on the ice tray 2 are separated from the ice tray 2 to be dropped into the ice storage container which is disposed on the under side of the ice tray 2.

Whether ice pieces on the ice tray 2 have been separated from the ice tray 2 or not is judged, for example, by means of that the ice tray 2 has been turned to a predetermined turning angle (for example, 160 degrees) which is larger than a turning angle at which the protruded part 23 for twisting of the ice tray 2 is abutted with the abutting part 43 of the frame body 4. Whether the ice tray 2 has been turned to the predetermined turning angle or not is detected, for example, by using the cam gear in the drive part 3.

After it is detected that the ice tray 2 has been turned to the predetermined turning angle (for example, 160 degrees) where it is judged that ice pieces on the ice tray 2 has been separated from the ice tray 2, the ice tray 2 is reversed to be returned to the first horizontal position. After that, water is supplied to the ice tray 2 again from the water-supply part not shown and ice pieces will be manufactured on the ice tray 2. In accordance with an embodiment of the present invention, before the ice tray 2 is reversed, the ice tray 2 may be stayed still for a predetermined time period at the predetermined turning angle where it is judged that ice pieces have been separated from the ice tray 2.

According to the ice making device 1 having the above-mentioned structure, the pawl insertion parts 45*a* and 45*b* which are the frame body side attaching parts of the frame body 4 and the pawl pieces 34*a* and 34*b* which are drive side attaching parts of the drive part 3 are fitted (inserted) to each other along the (horizontal) direction that is perpendicular to the output shaft 32 of the drive part 3 and, in this manner, the drive part 3 is attached to the frame body 4. Therefore, a dead space is not formed in the direction of the output shaft 32 of the drive part 3. In this case, although a space is provided due to attaching of the drive part 3 in the (horizontal) direction perpendicular to the output shaft 32 of the drive part 3, the space is utilized as the attaching space for the ice detecting member 5. Therefore, occurrence of an unnecessary space at the time of assembling is restrained and thus assembling property is improved.

The ice detecting member 5 is fitted and attached on the rear side in the moving direction of the drive part 3 along the (horizontal) direction that is perpendicular to the output shaft 32. The moving distance "l3" of the ice detecting member 5 at the time of fitting is set to be shorter than the moving distance "l1" of the drive part 3 when the drive part 3 is fitted and attached to the frame body 4. Therefore, the space in the (horizontal) direction perpendicular to the output shaft 32 which is used for attaching the drive part 3 can be utilized as a moving space for attaching the ice detecting member 5. Therefore, occurrence of an unnecessary space at the time of assembling is restrained and thus assembling property is improved.

Figure 7:
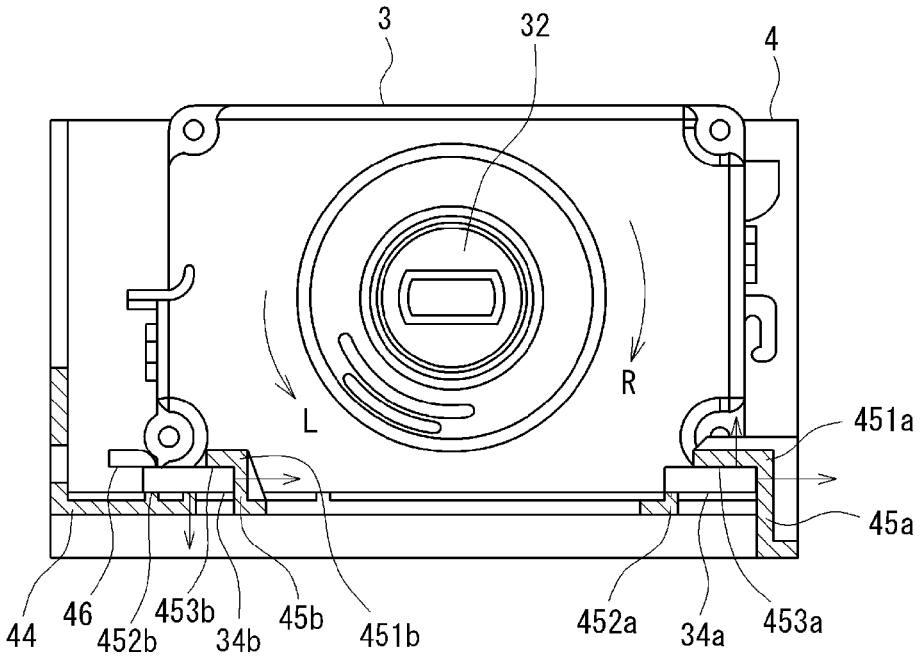
FIG. 7 is an explanatory schematic view showing a force occurred in the drive part when an ice tray is twisted.

Further, in the ice separating operation of the ice making device 1, as shown in FIG. 7, the output shaft 32 is turned in the clockwise direction (right side turning, direction of the arrow "R") when the output shaft 32 of the drive part 3 is viewed from the front side. When the ice tray 2 connected with the output shaft 32 is turned by turning of the output shaft 32, the protruded part 23 for twisting of the ice tray 2 is abutted with the abutting part 43 of the frame body 4. In this state, when the ice tray 2 is further turned, a twisting force is applied to the ice tray 2 and the ice tray 2 is twisted. The twisted ice tray 2 is applied with a force, which is going to return the twisted ice tray 2 to a state before twisted, in a direction opposite to the former turning direction and this force is transmitted to the output shaft 32. Therefore, the drive part 3 is applied with the force which is going to return the turning to the direction opposite to the former turning direction of the ice tray 2 (counterclockwise direction, direction of the arrow "L"). Accordingly, the pawl insertion part 45*a* of the frame body 4 into which the pawl piece 34*a* of the drive part 3 is inserted is received with a force toward an upper right direction from the pawl piece 34*a* of the drive part 3, and the pawl insertion part 45*b* into which the pawl piece 34*b* is inserted is received with a force toward the lower right direction from the pawl piece 34*b*. In other words, when the ice tray 2 is twisted, the pawl insertion parts 45*a* and 45*b* of the frame body 4 are received with forces in the right direction from the pawl pieces 34*a* and 34*b* of the drive part 3.

In the ice making device 1 in this embodiment, the pawl pieces 34*a* and 34*b* of the drive part 3 are inserted into the pawl insertion parts 45*a* and 45*b* of the frame body 4 in the right direction. In other words, the pawl pieces 34*a* and 34*b* of the drive part 3 are inserted into the pawl insertion parts 45*a* and 45*b* of the frame body 4 along the directions of the forces that the pawl insertion parts 45*a* and 45*b* of the frame body 4 are received from the pawl pieces 34*a* and 34*b* of the drive part 3 when the ice tray 2 is twisted. Further, the positions of the pawl pieces 34*a* and 34*b* in the horizontal direction are restricted by the pawl insertion pieces 451*a* and 451*b*. In other words, the moving direction of the drive part 3 when the drive part 3 is attached to the frame body 4 is set to be the same direction as the direction of the force in the horizontal direction which is transmitted to the pawl insertion parts 45*a* and 45*b* through the output shaft 32 of the drive part 3 from the ice tray 2 against the twisting applied to the ice tray 2. Therefore, the force in the horizontal direction acted on the drive part 3 which is going to return the turning of the drive part 3 with the twisting operation of the ice tray 2 is supported by the pawl insertion pieces 451*a* and 451*b* and thus disengagement of the drive part 3 from the frame body 4 is avoided. Accordingly, even when the ice tray 2 is twisted, the drive part 3 is fixed surely.

Further, in the ice separating operation of the ice making device 1, as shown in FIG. 7, at the time of twisting operation of the ice tray 2, when a force that is going to return the turning in the direction opposite to the turning direction of the ice tray 2 (counterclockwise direction, direction of the arrow "L") is acted on the drive part 3, the first pawl insertion part 45*a* of the frame body 4 into which the pawl piece 34*a* of the drive part 3 is inserted is received with the force from the pawl piece 34*a* of the drive part 3 in the upper right direction. On the other hand, the second pawl insertion part 45*b* of the frame body 4 is received with the force from the pawl piece 34*b* of the drive part 3 in the lower right direction. Therefore, the insertion piece side abutting face 453*a* of the first pawl insertion part 45*a* is received with a force in the vertical direction which is transmitted to the pawl piece 34*a* through the output shaft 32 of the drive part 3 from the ice tray 2 against the twisting applied to the ice tray 2, and the top plate side abutting face 452*b* of the second pawl insertion part 45*b* is received with a force in the vertical direction which is transmitted to the pawl piece 34*b*.

In this embodiment, the pawl insertion pieces 451*a* and 451*b* and the top plate 44 are structured so as not to overlap with each other in the upper and lower direction for the convenience of dies. In this case, in the first pawl insertion part 45*a*, the area of the insertion piece side abutting face 453*a* (first abutting face) is structured to be larger than the area of the top plate side abutting face 452*a* (second abutting face). In other words, in the first pawl insertion part 45*a*, the area of the insertion piece side abutting face 453*a* to which a force is applied at the time of twisting operation of the ice tray 2 (first abutting face) is set to be larger. On the other hand, in the second pawl insertion part 45*b*, the area of the top plate side abutting face 452*b* (first abutting face) is structured to be larger than the area of the insertion piece side abutting face 453*b* (second abutting face). In other words, in the second pawl insertion part 45*b*, the area of the top plate side abutting face 452*b* to which a force is applied at the time of twisting operation of the ice tray 2 (first abutting face) is set to be larger. In this manner, since the pawl pieces 34*a* and 34*b* of the drive part 3 are held further strongly, the holding force of the drive part 3 is superior. Further, the pawl insertion piece 451*a* to which a force is applied at the time of twisting operation of the ice tray 2 is reinforced by the reinforcing rib 47 and thus the holding force of the drive part 3 is further superior.

In this embodiment, at the time of a twisting operation of the ice tray 2, in the second pawl insertion part 45*b*, a force acted on the insertion piece side abutting face 453*b* is smaller than a force acted on the top plate side abutting face 452*b* which is going to return the turning of the drive part 3. Therefore, the insertion length "l2" of the pawl piece 34*b* to the second pawl insertion part 45*b* may be set in such a length that coming-off of the pawl piece 34*b* is prevented.

Although the present invention has been shown and described with reference to specific embodiments, various changes and modifications will be apparent to those skilled in the art from the teachings herein.

For example, in the embodiment described above, in order to attach the drive part 3 to the frame body 4, the pawl pieces 34*a* and 34*b* are provided in the drive part 3 and the pawl insertion parts 45*a* and 45*b* into which the pawl pieces 34*a* and 34*b* are inserted are provided in the frame body 4 and the pawl pieces 34*a* and 34*b* of the drive part 3 are inserted into the pawl insertion parts 45*a* and 45*b* of the frame body 4 along the (horizontal) direction perpendicular to the output shaft 32 of the drive part 3. However, a structure may be adopted that pawl pieces are provided in the frame body 4 and pawl insertion parts having opening parts into which the pawl pieces of the frame body 4 are capable of being inserted are provided in the drive part 3 and the pawl pieces of the frame body 4 are inserted into the pawl insertion parts of the drive part 3 along a (horizontal) direction perpendicular to the output shaft 32 of the drive part 3.

Further, in the embodiment described above, in order to attach the drive part 3 to the frame body 4, the drive part 3 is moved in the right direction. However, this direction corresponds to a turning direction of the drive part 3 for performing an ice separating operation and thus, when the turning direction of the drive part 3 for performing the ice separating operation is set to be the opposite direction, the moving direction of the drive part 3 is set to be the left direction.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

The invention claimed is:

1. An ice making device for use with an ice storage container; the ice making device comprising:

an ice tray;

a drive part which is provided with an output shaft to which the ice tray is attached and in which the ice tray is turned by turning of the output shaft; and a frame body to which the drive part is attached;

wherein a twisting operation is applied to the ice tray during a turning operation for separating ice pieces from the ice tray;

wherein the drive part is provided with a drive side attaching part;

the frame body is provided with a frame body side attaching part; and wherein the frame body side attaching part and the drive side attaching part are fitted to each other along a direction that is perpendicular to the output shaft, thereby attaching the drive part to the frame body wherein one end of a turning shaft of the ice tray is supported by the frame body, an other end of the turning shaft is fitted to the output shaft of the drive part and structured so that turning drive is transmitted, the ice tray is structured to be twisted by abutting a protruded part for twisting provided on one end side of the ice tray with an abutting part provided on the frame body, which disturbs turning of the ice tray; and an attaching direction of the drive part when the drive part is attached to the frame body is a same direction as a direction of force transmitted to the drive side attaching part through the output shaft of the drive part from the ice tray against twisting applied to the ice tray.

2. The ice making device according to claim 1, wherein the frame body side attaching part and the drive side attaching part are configured such that the drive part is attached to the frame body by moving the drive part in a moving direction perpendicular to the output shaft;

a space is provided between the drive part and the frame body on a rear side in the moving direction, and a rear side of the drive part in the moving direction is provided with an ice detecting member configured to detect an amount of ice pieces within the ice storage container which is disposed on an under side of the ice tray.

3. The ice making device according to claim 2, wherein the ice detecting member is fitted to an ice detecting shaft along the direction that is perpendicular to the output shaft, and a distance moved by the ice detecting member when the ice detecting member is fitted to the ice detecting shaft is shorter than a distance moved by the drive part when the drive part is attached to the frame body.

4. The ice making device according to claim 1, wherein the drive side attaching part is structured of a pawl piece which is protruded from the drive part, the frame body side attaching part is structured of a pawl insertion part into which the pawl piece is inserted, and an area of a first abutting face of the pawl insertion part which is abutted with the pawl piece and which is received with a force in a vertical direction transmitted to the pawl piece through the output shaft of the drive part from the ice tray against twisting applied to the ice tray is larger than an area of a second abutting face of the pawl insertion part which is abutted with the pawl piece and which is disposed at a position sandwiching the pawl piece with the first abutting face.

5. The ice making device according to claim 4, further comprising a reinforcing rib which reinforces the pawl insertion part on a first abutting face side of the pawl insertion part.

6. The ice making device according to claim 4, wherein the first abutting face and the second abutting face are not overlapped with each other in a direction perpendicular to the output shaft and in a direction perpendicular to an attaching direction of the drive part.

* * * * *